US007618043B1

(12) United States Patent
Hayden

(10) Patent No.: US 7,618,043 B1
(45) Date of Patent: Nov. 17, 2009

(54) METHOD OF PLAYING A BACCARAT CARD GAME VARIATION

(75) Inventor: Scott Hayden, Placentia, CA (US)

(73) Assignee: Dolchee LLP, Hayward, CA (US)

( * ) Notice: Subject to any disclaimer, the term of this patent is extended or adjusted under 35 U.S.C. 154(b) by 144 days.

(21) Appl. No.: 12/015,332

(22) Filed: Jan. 16, 2008

(51) Int. Cl.
*A63F 1/00* (2006.01)

(52) U.S. Cl. ..... 273/292; 273/274

(58) Field of Classification Search ..... 273/292, 273/274, 309; 463/12, 13
See application file for complete search history.

(56) References Cited

U.S. PATENT DOCUMENTS 5,529,309 A * 6/1996 Bartlett ..... 273/292
5,628,514 A * 5/1997 Nguyen et al. ..... 273/292
5,979,896 A * 11/1999 Lofink et al. ..... 273/274
6,237,917 B1 * 5/2001 Timpano ..... 273/292
6,582,302 B2 * 6/2003 Romero ..... 463/12

* cited by examiner

*Primary Examiner*—Benjamin H Layno
(74) *Attorney, Agent, or Firm*—Kali Law Group, P.C.

(57) ABSTRACT

Methods of playing a baccarat card game variation are presented including: providing a 52-card deck of playing cards; placing a wager a player bet line or a banker bet line by a player, where the wager includes a player bet line wager and a banker bet line wager; dealing a pair of cards to each of a banker hand and a community hand, where the banker hand includes a banker face-up card and a banker face-down card, and where the community hand includes a first community face-up card and a second community face-up card; if a community hand sum is less than 4, dealing a community hit card to the community hand; if the community hand sum is greater than 6, standing on the community hand; and if the community hand sum is greater than 3 and less than 7, optionally dealing a community hit card to the community hand.

17 Claims, 5 Drawing Sheets

METHOD OF PLAYING A BACCARAT CARD GAME VARIATION

BACKGROUND

Baccarat is a game that is usually played in a casino where one or more players play against a bank. In Europe, the bank is one of the players. In a typical casino in the United States, the bank is a dealer employed by the casino. In a card room in the State of California, the bank is a Third Party Provider of Proposition Player Services.

Before cards are dealt, a player makes a wager on either a player hand or a bank hand. Since the player makes the wager on either of the hands, there is an absence of a focused adversarial relationship between the player and the dealer. After a wager is made, two cards are dealt to form the player hand and two cards are dealt to form the bank hand. The hands are dealt from one or more standard decks of cards that are shuffled together. The rules of Baccarat provide for dealing a third card to the player hand and dealing a third card to the bank hand under certain conditions. Whether the player hand or the bank hand is a winning hand is determined by their point values. The hand with highest point value is the winning hand.

The point value of an example hand is obtained from the sum of the point values of cards that comprise the example hand. Face cards have a point value of zero. All other cards have a point value equal to their numerical face value with an ace having a point value of one. When the sum is a single digit number, the sum is the point value of the example hand. When the sum is a two digit number, the low order digit of the sum is the point value of the example hand. Therefore, the highest point value of a hand is nine. A natural is a term that is used to describe a hand, comprised of two cards, that has a point value of either eight or nine.

In some jurisdictions additional rules and regulations may regulate the play of card games. For example, in California, a card room running a card game may not collect a percentage of wagers; each player must be offered a turn as a player/dealer; and a card game may not rely solely on chance. In those circumstances, it may be advantageous to provide variations that not only provide gaming regulation compliance, but may also provide a more entertaining experience for players. As such, methods of playing a baccarat card game variation are provided herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Methods of playing a baccarat card game variation are presented including: providing a 52-card deck of playing cards; placing a wager a player bet line or a banker bet line by a player, where the wager includes a player bet line wager and a banker bet line wager; dealing a pair of cards to each of a banker hand and a community hand, where the banker hand includes a banker face-up card and a banker face-down card, and where the community hand includes a first community face-up card and a second community face-up card; if a community hand sum is less than 4, dealing a community hit card to the community hand; if the community hand sum is greater than 6, standing on the community hand; if the player has placed a wager on the player bet line, and if the community hand sum is greater than 3 and less than 7, optionally dealing a community hit card to the community hand, where each players independently elects to accept the community hit card, where a community hit sum is a sum of the community hit card and the community hand sum; revealing the banker face-down card of the banker hand; if a banker hand sum is less than 6, dealing a second banker face-up card to the banker hand, else standing on the banker hand; and resolving the wager. In some embodiments, methods are presented where the resolving the wager includes: if the banker hand sum is greater than the community hand sum, resolving the wager in favor of the banker bet line wager; if the banker hand sum is greater than the community hit sum, resolving the wager in favor of the banker bet line wager; if the community hand sum is greater than the banker hand, resolving the wager in favor of the player bet line wager; and if the community hit sum is greater than the banker hand, resolving the wager in favor of the player bet line wager. In some embodiments, methods further include: before the placing the wager, collecting a table fee based on a table limit. In some embodiments, methods further include: placing a wager on a tie bet line by the player, where the wager further includes a tie bet line wager; if the community hand sum is equal to the banker hand sum, resolving the wager in favor of the tie bet line wager, where the tie bet line wager is paid out with odds; and if the community hit sum is equal to the banker hand sum, resolving the wager in favor of the tie bet line wager, where the tie bet line wager is paid out with odds.

In other embodiments, methods playing a baccarat card game variation are presented including: providing a 52-card deck of playing cards; collecting a table fee based on a table limit; placing a wager on one of a player bet line and a banker bet line, where the wager includes a player bet line wager, a banker bet line wager, and a tie bet line wager; dealing a pair of cards to each of a banker hand and a community hand, where the banker hand includes a first banker face-up card and a banker face-down card, and where the community hand includes a first community face-up card and a second community face-up card; if the community hand sum is greater than 6, standing on the community hand if the player has placed a wager on the player bet line, and if a community hand sum is less than 4, dealing a player hit card to a player hand of the player, where the player hand includes the community hand and the player hit card, else if the community hand sum is greater than 3 and less than 7, optionally dealing the player hit card to the player hand, where each of the players independently elect to accept the player hit card, where a player hand sum is a sum of the player hit card and the community hand sum; revealing the banker face-down card of the banker hand; and resolving the wager. In some embodiments, methods are presented where the resolving the wager includes: if a banker hand sum is less than 6, dealing a second banker face-up card to the banker hand, else standing on the banker hand; if the banker hand sum is greater than the community hand sum, resolving the wager in favor of the banker bet line wager; if the banker hand sum is greater than the player hand sum, resolving the wager in favor of the banker bet line wager; if the community hand sum is greater than the banker hand, resolving the wager in favor of the player bet line wager; if the player hand sum is greater than the banker hand, resolving the wager in favor of the player bet line wager; if the community hand sum is equal to the banker hand sum, resolving the wager in favor of the tie bet line wager, where the tie bet line wager is paid out with odds; and if the player hand sum is equal to the banker hand sum, resolving the wager in favor of the tie bet line wager, where the tie bet line wager is paid out with odds. In some embodiments, methods are presented, where the table fee is equal to one percent of a maximum of the table limit, where the tie bet line wager is equal to or less than the player bet line wager and the banker bet line wager, where the wager for the player does not exceed the table limit, and where the odds have a formula of x:1, where x is an integer.

BRIEF DESCRIPTION OF THE DRAWINGS

The present invention is illustrated by way of example, and not by way of limitation, in the figures of the accompanying drawings and in which like reference numerals refer to similar elements and in which.

GLOSSARY

| | |
|---|---|
| Action Button | An Action Button is a specially marked object that may be placed beside the betting boxes of the Players who will be first to: a) Have their cards read; and b) Be paid by, or lose to a DP. |
| Action | What the betting and playing in a particular hand or game is called. A game with a lot of betting is an action game. |
| Bet (or Wager) | Chips placed on the table in a betting square. |
| Betting Square | A specially marked area on the table designated specifically for bets or wagers. Examples include: a Player bet line, a Banker bet line, and a Tie bet line. |
| Boxed Card | A card that is turned face up in the deck. |
| Chip | A round token representing a cash value. Chips may be provided in various denominations. |
| Dead Hand | A hand that a player may not continue to play because of an irregularity |
| Deck | A standard deck of 52 playing cards. |
| Designated Player (DP) | A DP is a Player/Banker (or Player/Dealer) who covers wagers on a table. |
| DP Position | The betting spot that the Designated Player is occupying |
| Draw | Optional cards added to initial cards |
| Drop | This is an interchangeable term for Time Collection, Fee, Time Fee, Table Fee, and any other term used to describe the amount paid to the house to play |
| Hit | See Draw |
| Table Limit | The amount a player may bet in a betting square |
| Position | The spot in the sequence around the table in which a player is located |
| Shoe | A Shoe is a container from which multiple decks are dealt. |
| Wager | See Bet |

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
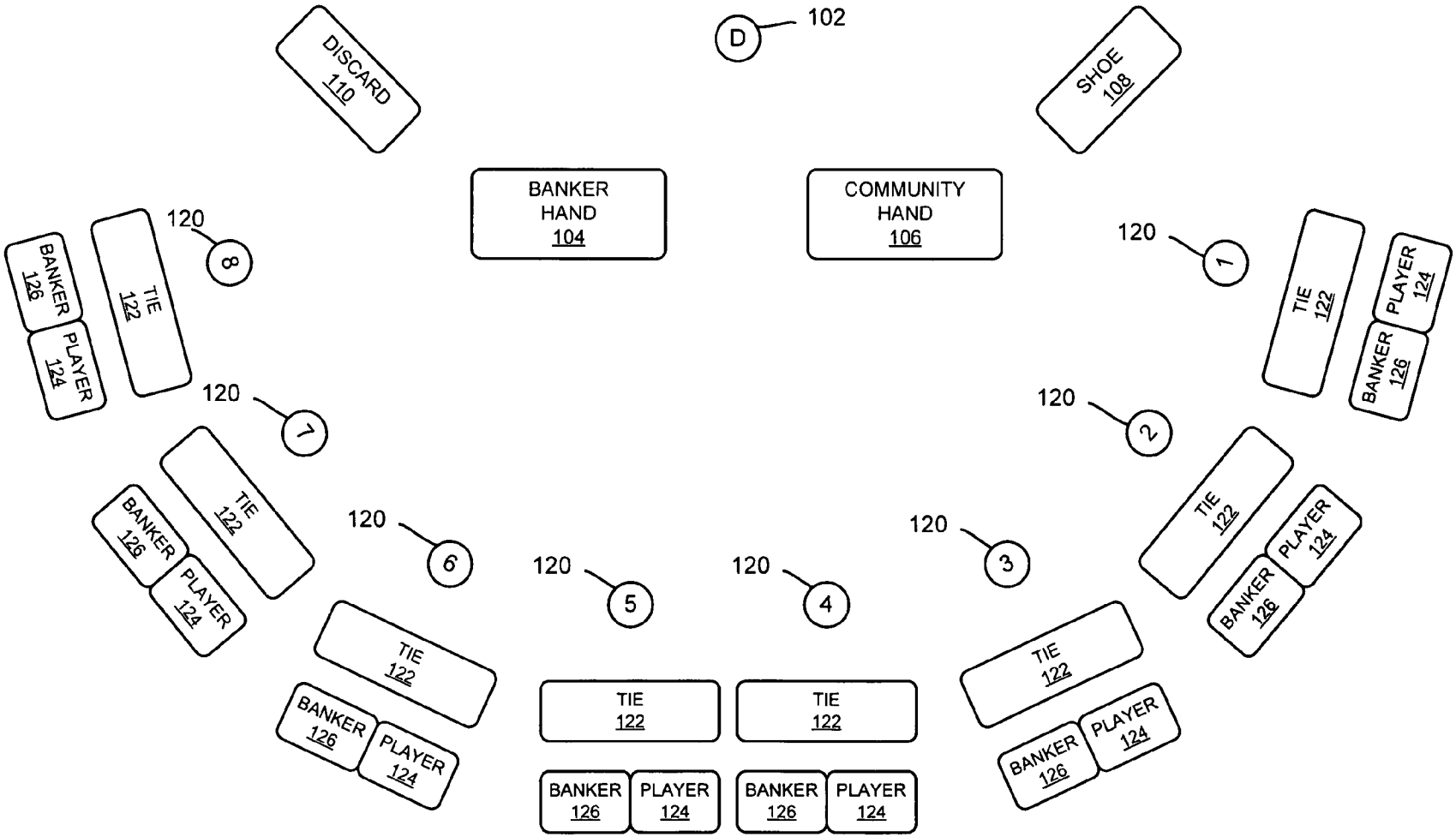
FIG. 1 is an illustrative representation of baccarat card game variation playing table arrangement in accordance with embodiments of the present invention.

FIG. 1 is an illustrative representation of baccarat card game variation playing table arrangement 100 in accordance with embodiments of the present invention. As illustrated, a house dealer position 102 may be situated to provide access to all player position 120. In some embodiments, a player/dealer may be utilized instead of a house dealer. House dealer position may include a shoe 108 for providing shuffled cards. Embodiments may include 1 or more decks of playing cards. A deck of playing cards is a standard deck of 52 cards with no joker or wild cards. Decks may be shuffled after every hand or may be shuffled only after all cards have been played from the shoe. In some embodiments, a shoe may not be required. A discard area 110 may be utilized to temporarily collect played cards from the field of play. In some embodiments, a shuffle machine may also be utilized. A shuffle machine operates to continuously shuffle the cards. Thus, after every hand, played cards may be placed in a shuffle machine and shuffled with cards remaining in the shuffle machine. As may be appreciated, a shuffle machine obviates the need for a discard area. In embodiments, as well as many variations on a baccarat-like card game, a banker hand position 104 and a community hand position 106 provide temporary playing areas for dealt cards. It may be appreciated that the location and nomenclature utilized are for further clarifying embodiments of the present invention and are not intended to be limiting in any way.

As illustrated, 8 player positions 120 are indicated, although in some embodiments, a single player may play against the house. In some jurisdictions where the house cannot participate, at least two players must play. Jurisdictional constraints will be discussed in further detail below. Player positions 120 are indicated from 1 to 8 in clockwise fashion, which order is arbitrary and not intended to be limiting. Player positions, in some embodiments, may indicate an order of play. Thus, a player in a first position may play first on a hand and subsequently play last on a next hand. In embodiments, a player position may also indicate a player/dealer position. That is, the duties of a player/dealer may rotate though the players sequentially in order of player position. In some embodiments, a player may optionally decline to serve as a player/dealer. In some embodiments, position 120 may also serve to accommodate a player hit card or a player hand. Player hit cards and player hands will be discussed in further detail below for FIGS. 4-5.

Each player position 120 may further include a tie bet line 122, a banker bet line 126, and a player bet line 124. A tie bet line 122 may be utilized for placing a tie bet line wager; a banker bet line 126 may be utilized for placing a banker bet line wager; and a player bet line 124 may be utilized for placing a player bet line wager. Once a wager is placed, it may not be removed. In embodiments, wagers may not exceed a table limit imposed by the house. However, in some embodiments, a player/dealer may make a wager in excess of a table limit. In some embodiments, a tie bet line wager may not exceed either a player bet line wager or a banker bet line wager. In still other embodiments, a tie bet line wager may be paid out with odds having a formula of x:1 where x is an integer. In some embodiments, odds may be more preferably calculated at 7:1, 8:1, or 9:1 odds. As may be appreciated, the illustrated disposition of bet lines is arbitrary and not intended as limiting.

Figure 2:
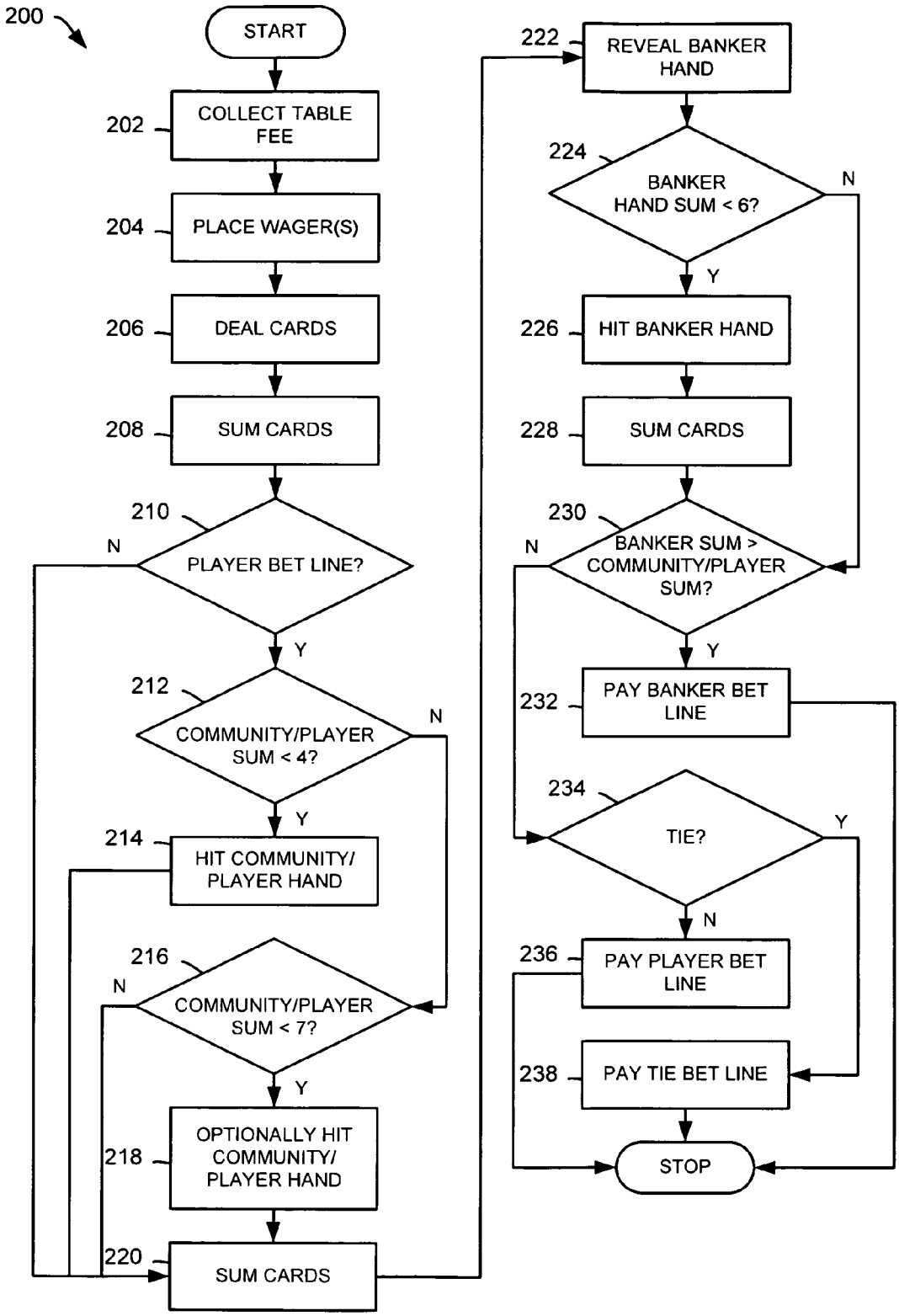
FIG. 2 is an illustrative flowchart for playing a baccarat card game variation in accordance with embodiments of the present invention.

FIG. 2 is an illustrative flowchart 200 for playing a baccarat card game variation in accordance with embodiments of the present invention. At a first step 202, a table fee is collected. In some conventional baccarat and baccarat-like card games, table fees may be collected which represent some percentage of wagers made for each hand played. In some cases, this may unduly complicate or slow the game. In embodiments described herein a table fee may be collected before each hand is played where the table fee is some nominal fee. In some embodiments, a table fee is based on a table limit. In embodiments, table fees may be calculated in accordance with the following table:

TABLE 1

| Table Limit | Player Table Fee | Player/Dealer Table Fee |
|---|---|---|
| $10.00-100.00 | $1.00 per hand | $3.00 per hand |
| $40.00-200.00 | $2.00 per hand | $5.00 per hand |
| $100.00-200.00 | $2.00 per hand | $5.00 per hand |
| $200.00 | $2.00 per hand | $5.00 per hand |

It may be appreciated that the above table is for illustrative purposes only and not intended to be limiting in any manner. Indeed, a house may determine any fee by any method known in the art without departing from the present invention.

At a next step 204, all wagers are placed. As noted above, each player may place a banker bet line wager or a player bet line wager. In addition, each player may place a tie bet line wager. Resolution of wagers will be discussed in further detail below for steps 232 to 238. In embodiments, wagers may not exceed a table limit imposed by the house. However, in some embodiments, a player/dealer may bet in excess of a table limit. In some embodiments, a tie bet line wager may not exceed either a player bet line wager or a banker bet line wager. In still other embodiments, a tie bet line wager may be paid out with odds having a formula of x:1 where x is an integer. In some embodiments, odds may be more preferably calculated at 7:1, 8:1, or 9:1 odds.

At a next step 206, cards are dealt. Cards may be dealt from one or more shuffled playing card decks of 52 cards with no jokers or wild cards. A dealer may deal a pair of cards to each of a banker hand and a community hand. In some embodiments, a dealer may deal two cards to a banker hand and then two cards to a community hand or vice verse. In some embodiments, a dealer may first deal a card to each of a banker hand and a community hand and may then deal a second card to each of the banker hand and the community hand. As such, any order of dealing may be made without departing from the present invention. In embodiments, the banker hand includes one face-up card and one face-down card while the community hand includes two face-up cards. In some embodiments, each player may be dealt an individual player hand instead of a single community hand for all players. The hands are summed at a next step 208.

At a next step 210, the method determines whether a player has made a player bet line wager. If the method determines at a step 210 that a player has made a player bet line wager, the method proceeds to a step 212 to determine whether the community hand sum or player hand sum is less than 4. If the method determines that the community hand sum or the player hand sum is less than 4 at a step 212, the method hits the community hand or the player hand. In embodiments, a hit occurs when a dealer or player/dealer deals a community hit card to the community hand or when a dealer or player/dealer deals a player hit card to a player hand. The method then continues to a step 220 to sum the hand. In some embodiments, as noted above, each player may be dealt a separate hand. In some embodiments, a combination of a community hand and a player hand may be utilized, which are briefly described below for FIG. 4. Sums are calculated in a similar manner for all variations in accordance with standard baccarat rules.

If the method determines that the community hand sum or the player hand sum is not less than 4 at a step 212, the method continues to a step 216 to determine whether a community hand sum or a player hand sum is less than 7. If the method determines that the community hand sum or the player hand sum is less than 7 at a step 216, the method optionally hits the community hand or the player hand. That is, a player may elect whether or not to receive a hit card. In embodiments, a hit occurs when a dealer or player/dealer deals a community hit card to the community hand or when a dealer or player/dealer deals a player hit card to a player hand. In this manner, a decision element is added to the game and, as such, the game is not governed entirely by chance. The method then continues to a step 220 to sum the hand.

If the method determines that the community hand sum or the player hand sum is not less than 7 at a step 216, the method continues to a step 220 to sum the hand. Returning to a step 210, if the method determines at a step 210 that a player has not made a player bet line wager, the method proceeds to a step 220 to sum the hand. As may be appreciated, steps 210 to 220 may be repeated for each player. In some embodiments, the order of play may be determined by rotation from position to position.

At a next step 222, the bank hand is revealed. That is, the banker hand face-down card is turned over. The method then determines at a step 224 whether the bank hand sum is less than 6. If the method determines at a step 224 that the bank hand is less than 6, the method hits the bank hand at a step 226. As above, in embodiments, a hit occurs when a dealer or player/dealer deals a banker hit card to the banker hand. The method then continues to a step 228 to sum the hand. If the method determines at a step 224 that the bank hand is not less than 6, the method continues to a step 230 to determine whether the banker hand sum is greater than the community hand sum or the player hand sum. If the method determines at a step 230 that the banker hand sum is greater than the community hand sum or the player hand sum, the method resolves the wager in favor of the banker bet line at a step 232 whereupon the method ends.

If the method determines at a step 230 that the banker hand sum is not greater than the community hand sum or the player hand sum, the method continues to a step 234 to determine whether a tie between the banker hand sum and the community hand sum or the player hand sum exists. If the method determines at a step 234 that a tie exists, the method resolves the wager in favor of the tie bet line at a step 238 whereupon the method ends. If the method determines at a step 234 that a tie does not exist, the method resolves the wager in favor of the player bet line at a step 238 whereupon the method ends. As may be appreciated, resolution of a wager if favor of a particular player depends on which bet line the player has placed a wager. Therefore, if a player has placed a tie bet line wager, then a wager resolved in favor of the tie bet line is resolved in favor of the player. Resolution of a player bet line wagers and a banker bet line wagers are handled in like manner.

Playing rules described above for embodiments are presented in table form for ease of understanding:

TABLE 2

| Player Rules | | |
|---|---|---|
| Must Hit On: | Have Option On: | Must Stand On: |
| 3 OR LESS | 4, 5, OR 6 | 7 OR MORE |

TABLE 3

| Player/Dealer Rules | | |
|---|---|---|
| Must Hit On: | Have Option On: | Must Stand On: |
| 5 OR LESS | N/A | 6 OR MORE |

Figure 3:
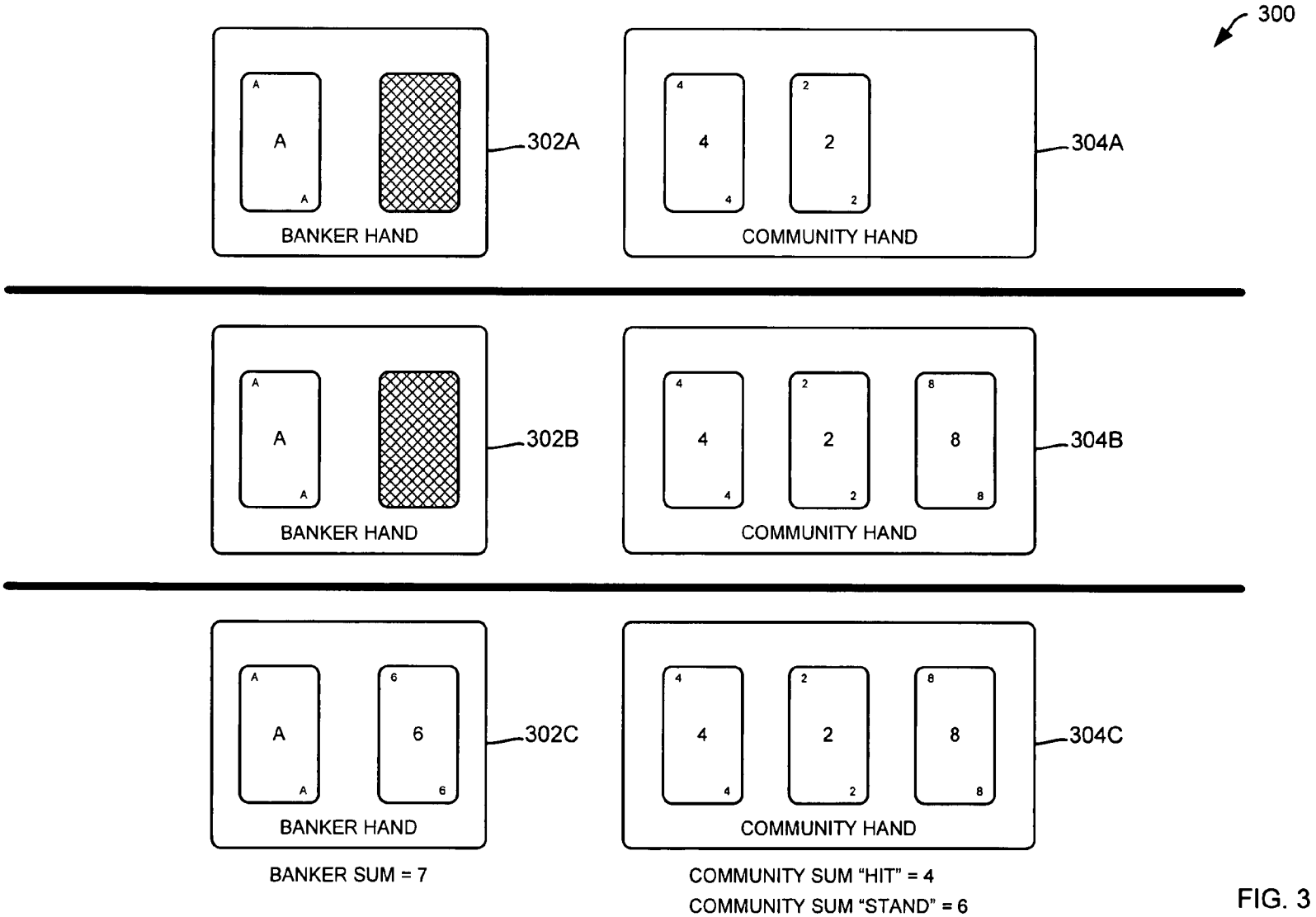
FIG. 3 is an illustrative representation of a played hand of a baccarat card game variation utilizing a community hand in accordance with embodiments of the present invention.
Figure 4:
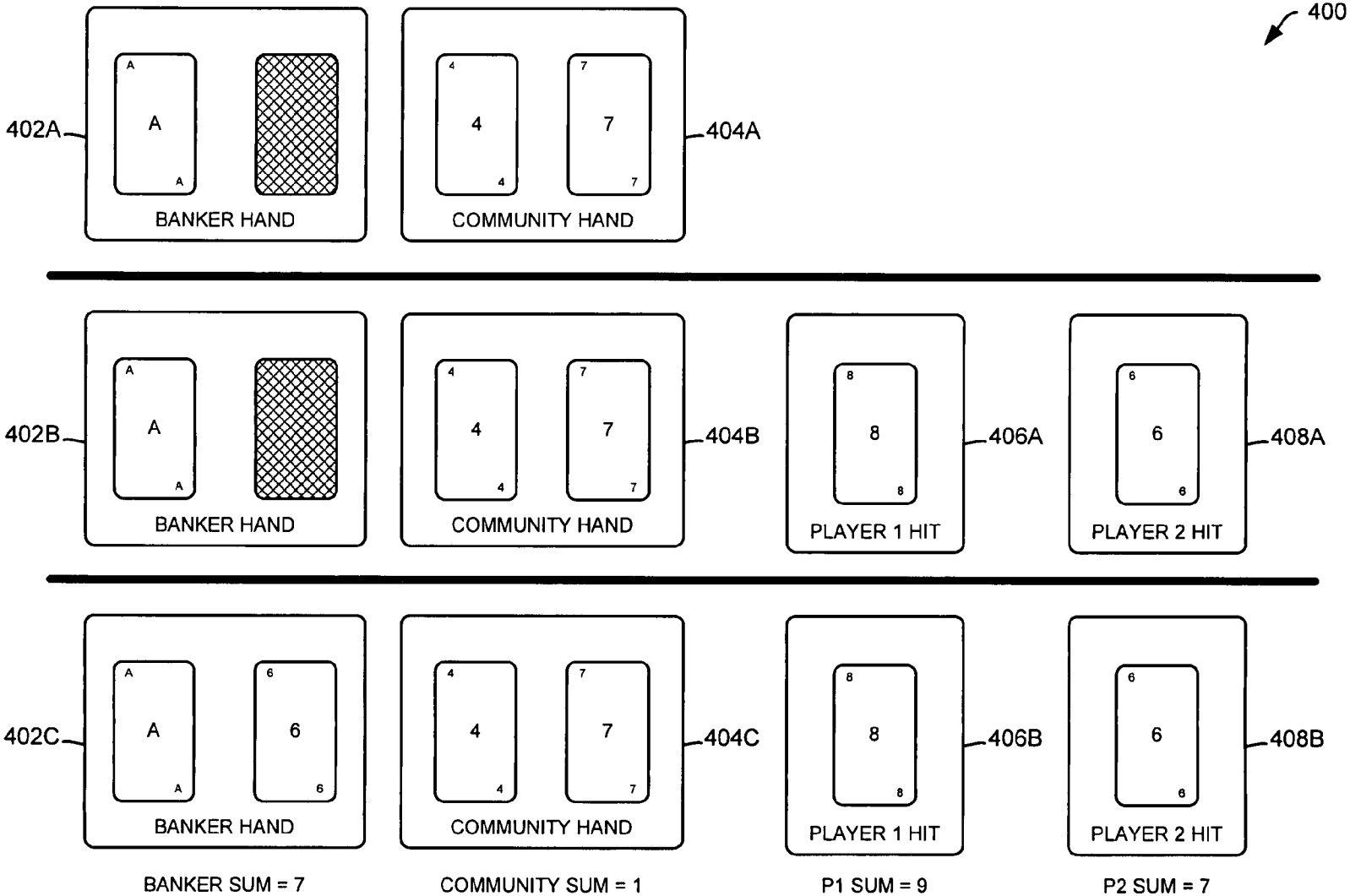
FIG. 4 is an illustrative representation of a played hand of a baccarat card game variation utilizing a community hand and a player hand in accordance with embodiments of the present invention.
Figure 5:
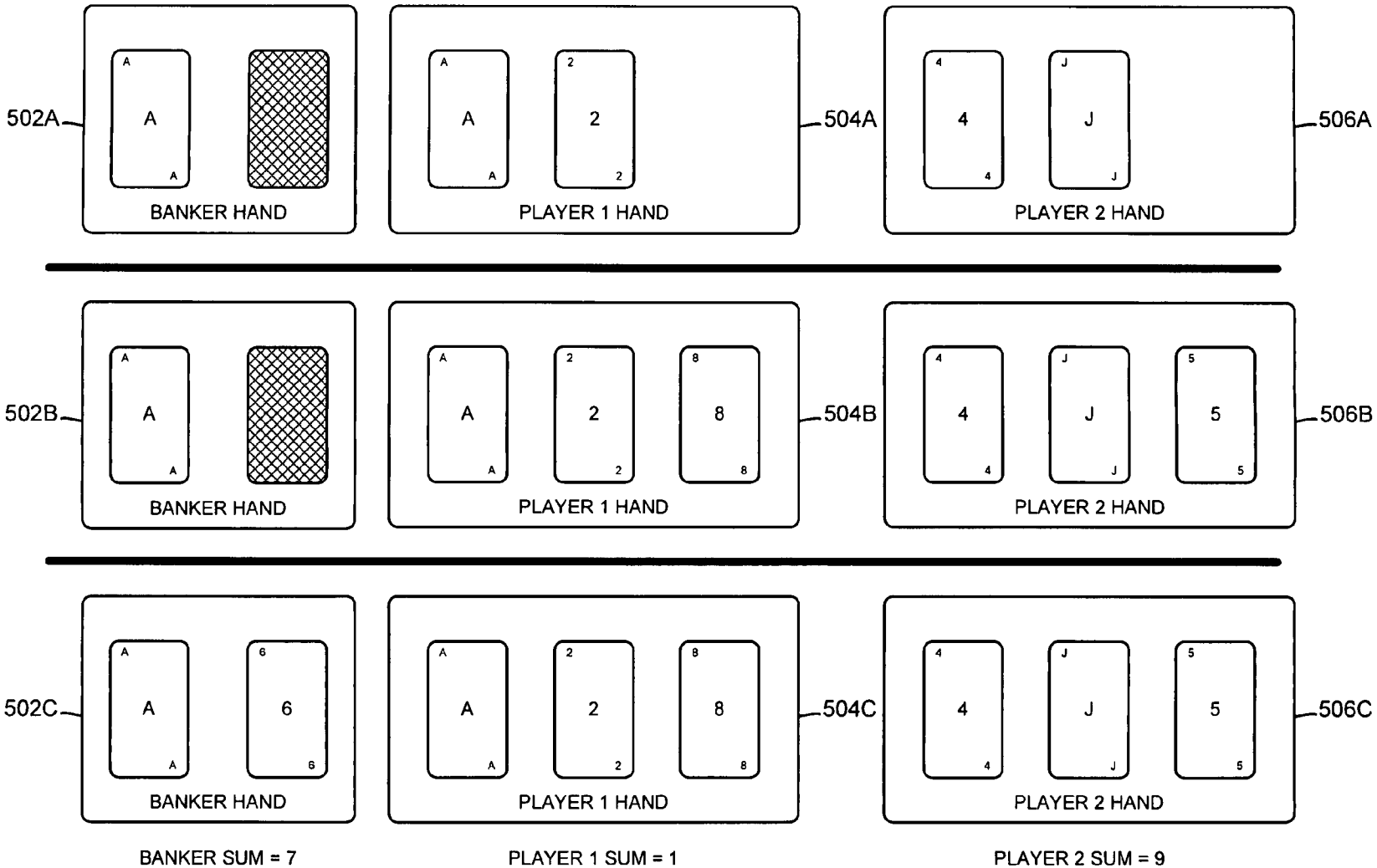
FIG. 5 is an illustrative representation of a played hand of a baccarat card game variation utilizing a player hand in accordance with embodiments of the present invention.

FIGS. 3 to 5 are provided for clarity in understanding variations on embodiments disclosed herein. Each figure will be discussed with reference to FIG. 2 for clarity's sake. FIG. 3 is an illustrative representation 300 of a played hand of a baccarat card game variation utilizing a community hand 304 in accordance with embodiments of the present invention. As illustrated, a banker hand 302A and a community hand 304A are dealt as in a step 206 (see FIG. 2). The sum of community hand 304A is 6. As such, a player having a bet on a player bet line may optionally elect to receive a community card as in a step 218. Community hand 304B is illustrated as having received a hit card. Bank hand 302B remains unrevealed. It may be appreciated that in some embodiments, a hand may include players who elect to hit and players who elect to stand. Banker hand 302C may then be revealed as in a step 222. Banker hand 302C is summed. Since banker hand sum is greater than 6, as in a step 224, the banker must stand. All hands are then summed as in a step 228.

As illustrated, banker hand sum of banker hand 302C is 7. In addition a "hit" community hand sum of community hand 304C is 4 and a "stand" community hand sum of community hand 304C is 6. In this example, banker hand sum is greater than all community hand sums. Thus, wagers are resolved in favor of the banker bet line as in a step 232. That is, if a player made a player bet line wager or a tie bet line wager, the player loses the wager. Further, if a player made a banker bet line wager, the player wins the wager.

FIG. 4 is an illustrative representation 400 of a played hand of a baccarat card game variation utilizing a community hand 404, a player hand one 406, a player hand two 408 in accordance with embodiments of the present invention. As illustrated, a banker hand 402A and a community hand 404A are dealt as in a step 206 (see FIG. 2). The sum of community hand 404A is 1. As such, a player having a bet on a player bet line must receive a hit card as in a step 214. Player hand one 406A and player hand two 408A are illustrated as each having received a hit card. Bank hand 402B remains unrevealed and community hand 404B remains untouched. Banker hand 402C may then be revealed as in a step 222. Banker hand 402C is summed. Since banker hand sum is greater than 6, as in a step 224, the banker must stand. All hands are then summed as in a step 228.

As illustrated, banker hand sum of banker hand 402C is 7. Player hand one 406B is summed with community hand 404C for a sum of 9. Player hand two 408B is summed with community hand 404C for a sum of 7. In this example, player hand one sum is greater than banker hand sum, so a wager is resolved in favor of a player bet line. That is, if player one made a banker bet line wager or a tie bet line wager, then player one loses the wager. Further, if player one made a player bet line wager, then player one wins the wager. Additionally, player hand two sum is tied with banker hand sum, so a wager is resolved in favor of a tie bet line. That is, if player two made a banker bet line wager or a player bet line wager, then player two loses the wager. Further, if player two made a tie bet line wager, then player two wins the wager. It may be appreciated that although only two players are illustrated, any number of players may be included without departing from the present invention.

FIG. 5 is an illustrative representation 500 of a played hand of a baccarat card game variation utilizing a player hand one 504 and a player hand two 506 in accordance with embodiments of the present invention. As illustrated, a banker hand 502A, a player hand one 504A, and a player hand two 506A are dealt as in a step 206 (see FIG. 2). The sum of player hand one 504A is 3. As such, a player hand must receive a hit card as in a step 216. Player hand one 504B is illustrated as having received a hit card. The sum of player hand two 506A is 4. As such, player two may optionally elect to receive a hit card as in a step 218. Player hand two 506B is illustrated as having received a hit card. Bank hand 502B remains unrevealed. Banker hand 502C may then be revealed as in a step 222. Banker hand 502C is summed. Since banker hand sum is greater than 6, as in a step 224, the banker must stand. All hands are then summed as in a step 228.

As illustrated, banker hand sum of banker hand 502C is 7. Player hand one sum of player hand one 504C is 1. Player hand two sum of player hand two 506C is 9. In this example, player hand one sum is less than banker hand sum, so a wager is resolved in favor of a banker bet line. That is, if player one made a player bet line wager or a tie bet line wager, then player one loses the wager. Further, if player one made a banker bet line wager, then player one wins the wager. Additionally, player hand two sum is greater than banker hand sum, so a wager is resolved in favor of a player bet line. That is, if player two made a banker bet line wager or a tie bet line wager, then player two loses the wager. Further, if player two made a player bet line wager, then player two wins the wager. It may be appreciated that although only two players are illustrated, any number of players may be included without departing from the present invention.

Jurisdictional Considerations

Embodiments of the present invention may be particularly useful is some jurisdictions that incorporate additional rules and regulations. For example, in California, a player/dealer position must rotate between players in a systematic and continuous fashion so that the player/dealer does not remain with a player for two consecutive hands or rounds of play. A position marker may be utilized in some embodiments to indicated a player/dealer position as described above for FIG. 1 to meet a particular jurisdiction's rules and regulations. In some examples, an offer to take a position as player/dealer must be made, but not necessarily accepted.

In traditional baccarat and baccarat-like versions, a player/dealer must be willing to cover all wagers. However, in some embodiments, a player/dealer are never required to cover all wagers in accordance with jurisdictional rules and regulations. In those examples, payoffs may be limited to an amount wagered by a player/dealer. In some embodiments, a player/dealer may have no maximum wager. In addition, in some embodiments, a third party proposition player may be permitted to play and/or hold a player/dealer position in accordance with jurisdictional rules and regulations. A third party proposition player may be utilized to cover all wages at a table within table limits. In addition, a house dealer, in some embodiments, is never a player/dealer. Furthermore, in some embodiments, the house does not collect a percentage of wagers placed in a game, but instead may collect a table fee based on table limits. Embodiments provided herein may conform to any number of jurisdictional considerations to provide a legal and positive player experience.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A method of playing a baccarat card game variation comprising:

providing at least one 52-card deck of playing cards;

placing a wager on one of a player bet line and a banker bet line by at least one player, wherein the wager includes a player bet line wager and a banker bet line wager;

dealing a pair of cards to each of a banker hand and a community hand, wherein the banker hand includes a first banker face-up card and a banker face-down card, and wherein the community hand includes a first community face-up card and a second community face-up card;

if a community hand sum is less than 4, dealing a community hit card to the community hand;

if the community hand sum is greater than 6, standing on the community hand;

if the at least one player has placed a wager on the player bet line, and if the community hand sum is greater than 3 and less than 7, optionally dealing a community hit card to the community hand, wherein each of the at least one players independently elects to accept the community hit card, wherein a community hit sum is a sum of the community hit card and the community hand sum;

revealing the banker face-down card of the banker hand;

if a banker hand sum is less than 6, dealing a second banker face-up card to the banker hand, else standing on the banker hand; and resolving the wager.

2. The method of claim 1, wherein the resolving the wager comprises:

if the banker hand sum is greater than the community hand sum, resolving the wager in favor of the banker bet line wager;

if the banker hand sum is greater than the community hit sum, resolving the wager in favor of the banker bet line wager;

if the community hand sum is greater than the banker hand, resolving the wager in favor of the player bet line wager; and if the community hit sum is greater than the banker hand, resolving the wager in favor of the player bet line wager.

3. The method of claim 1, further comprising: before the placing the wager, collecting a table fee based on a table limit.

4. The method of claim 3, wherein the dealing is accomplished by a dealer selected from the group consisting of: a house dealer and a player/dealer.

5. The method of claim 4, wherein each of the at least one player represents a position, wherein the position designates an order of play, and wherein the order of play is rotated among the at least one player.

6. The method of claim 5, wherein the position further designates the player/dealer.

7. The method of claim 6, wherein a player/dealer wager is not limited by the table limit.

8. The method of claim 1, further comprising:

placing a wager on a tie bet line by the at least one player, wherein the wager further includes a tie bet line wager;

if the community hand sum is equal to the banker hand sum, resolving the wager in favor of the tie bet line wager, wherein the tie bet line wager is paid out with odds; and if the community hit sum is equal to the banker hand sum, resolving the wager in favor of the tie bet line wager, wherein the tie bet line wager is paid out with odds.

9. The method of claim 8, wherein the tie bet line wager is equal to or less than the player bet line wager and the banker bet line wager.

10. The method of claim 9, wherein the wager for the at least one player does not exceed a table limit.

11. The method of claim 8, wherein the odds have a formula of x:1, where x is an integer.

12. A method of playing a baccarat card game variation comprising:

providing at least one 52-card deck of playing cards;

collecting a table fee based on a table limit;

placing a wager on one of a player bet line and a banker bet line by at least one player, wherein the wager includes a player bet line wager, a banker bet line wager, and a tie bet line wager;

dealing a pair of cards to each of a banker hand and a community hand, wherein the banker hand includes a first banker face-up card and a banker face-down card, and wherein the community hand includes a first community face-up card and a second community face-up card;

if a community hand sum is less than 4, dealing a community hit card to the community hand;

if the community hand sum is greater than 6, standing on the community hand;

if the at least one player has placed a wager on the player bet line, and if the community hand sum is greater than 3 and less than 7, optionally dealing a community hit card to the community hand, wherein each of the at least one players independently elects to accept the community hit card, wherein a community hit sum is a sum of the community hit card and the community hand sum;

revealing the banker face-down card of the banker hand;

if a banker hand sum is less than 6, dealing a second banker face-up card to the banker hand, else standing on the banker hand;

if the banker hand sum is greater than the community hand sum, resolving the wager in favor of the banker bet line wager;

if the banker hand sum is greater than the community hit sum, resolving the wager in favor of the banker bet line wager;

if the community hand sum is greater than the banker hand, resolving the wager in favor of the player bet line wager;

if the community hit sum is greater than the banker hand, resolving the wager in favor of the player bet line wager;

if the community hand sum is equal to the banker hand sum, resolving the wager in favor of the tie bet line wager, wherein the tie bet line wager is paid out with odds; and if the community hit sum is equal to the banker hand sum, resolving the wager in favor of the tie bet line wager, wherein the tie bet line wager is paid out with odds.

13. The method of claim 12, wherein the table fee is equal to one percent of a maximum of the table limit, wherein the tie bet line wager is equal to or less than the player bet line wager and the banker bet line wager, wherein the wager for the at least one player does not exceed the table limit, and wherein the odds have a formula of x:1, where x is an integer.

14. The method of claim 12, wherein the dealing is accomplished by a dealer selected from the group consisting of: a house dealer and a player/dealer, wherein each of the at least one player represents a position, wherein the position designates an order of play, and wherein the order of play is rotated among the at least one player, wherein the position further designates the player/dealer, and wherein a player/dealer wager is not limited by a table limit.

15. A method of playing a baccarat card game variation comprising:

providing at least one 52-card deck of playing cards;

collecting a table fee based on a table limit;

placing a wager on one of a player bet line and a banker bet line, wherein the wager includes a player bet line wager, a banker bet line wager, and a tie bet line wager;

dealing a pair of cards to each of a banker hand and a community hand, wherein the banker hand includes a first banker face-up card and a banker face-down card, and wherein the community hand includes a first community face-up card and a second community face-up card;

if the community hand sum is greater than 6, standing on the community hand if the at least one player has placed a wager on the player bet line, and if a community hand sum is less than 4, dealing a player hit card to a player hand of the at least one player, wherein the player hand includes the community hand and the player hit card, else if the community hand sum is greater than 3 and less than 7, optionally dealing the player hit card to the player hand, wherein each of the at least one players independently elects to accept the player hit card, wherein a player hand sum is a sum of the player hit card and the community hand sum;

revealing the banker face-down card of the banker hand; and resolving the wager.

16. The method of claim 15, wherein the resolving the wager comprises:

if a banker hand sum is less than 6, dealing a second banker face-up card to the banker hand, else standing on the banker hand;

if the banker hand sum is greater than the community hand sum, resolving the wager in favor of the banker bet line wager;

if the banker hand sum is greater than the player hand sum, resolving the wager in favor of the banker bet line wager;

if the community hand sum is greater than the banker hand, resolving the wager in favor of the player bet line wager;

if the player hand sum is greater than the banker hand, resolving the wager in favor of the player bet line wager;

if the community hand sum is equal to the banker hand sum, resolving the wager in favor of the tie bet line wager, wherein the tie bet line wager is paid out with odds; and if the player hand sum is equal to the banker hand sum, resolving the wager in favor of the tie bet line wager, wherein the tie bet line wager is paid out with odds.

17. The method of claim 15, wherein the table fee is equal to one percent of a maximum of the table limit, wherein the tie bet line wager is equal to or less than the player bet line wager and the banker bet line wager, wherein the wager for the at least one player does not exceed the table limit, and wherein the odds have a formula of x:1, where x is an integer.

* * * * *